United States Patent [19]

Fitzgerald et al.

[11] Patent Number: 4,842,241

[45] Date of Patent: Jun. 27, 1989

[54] LIGHTWEIGHT PLASTIC CONCRETE MOLD

[75] Inventors: John M. Fitzgerald, Lake Bluff; Gary L. Workman, Lombard, both of Ill.

[73] Assignee: Deslauriers, Inc., Bellwood, Ill.

[21] Appl. No.: 190,655

[22] Filed: May 5, 1988

[51] Int. Cl.[4] ..... B28B 7/22; E04G 11/50

[52] U.S. Cl. ..... 249/50; 249/48; 249/134; 249/165; 249/172; 249/DIG. 4

[58] Field of Search ..... 249/48, 50, 51, 112, 249/155, 134, 160, 165, 143, 170–172, DIG. 4; 425/451.9; D15/136

[56] References Cited

U.S. PATENT DOCUMENTS

| | | | |
|---|---|---|---|
| D. 245,250 | 8/1977 | Hamilton | D15/136 |
| 1,153,846 | 9/1915 | Hostetler et al. | 249/160 |
| 1,192,425 | 7/1916 | Howard et al. | 249/160 |
| 1,417,246 | 5/1922 | Hazeltine | 249/160 |
| 1,639,934 | 8/1927 | Ferring | 249/172 |
| 1,642,581 | 9/1927 | Foster | 249/160 |
| 3,021,586 | 2/1962 | Uruburu | 249/48 |
| 3,385,554 | 5/1968 | Anderson | 249/165 |
| 3,601,355 | 8/1971 | Fleck | 249/50 |
| 4,047,690 | 9/1977 | Winter et al. | 249/DIG. 4 |
| 4,239,176 | 12/1980 | Salazar | 249/160 |

FOREIGN PATENT DOCUMENTS

| | | | |
|---|---|---|---|
| 2041888 | 3/1972 | Fed. Rep. of Germany | 249/112 |
| 1193471 | 11/1959 | France | 249/50 |
| 2266579 | 10/1975 | France | 249/DIG. 4 |
| 2539169 | 7/1984 | France | 249/50 |

OTHER PUBLICATIONS

Copy of the cover page and pages 5, 6, 141, 142 and 311 of the 1984 Annual Book of ASTM Standards published by ASTM.

Copy of page 44 of a catalog of Rainhart Company of Austin, Tex., with publication, 12/1986.

Copy of page 15 of a catalog of Humboldt Mfg. Co. of Chicago, Ill. which was published 12/1986 is a copy of page 185 of a catalog of Soiltest Inc. of Evanston, Ill., with the catalog being published 12/1986.

*Primary Examiner*—Jay H. Woo
*Assistant Examiner*—C. Scott Bushey
*Attorney, Agent, or Firm*—Wood, Dalton, Phillips Mason & Rowe

[57] ABSTRACT

A mold for forming concrete having a bottom, a pair of side walls and a pair of end walls, all of plastic, and with the side walls and bottom being of integral one-piece construction and hinged together by living hinges defined by reduced thickness of the plastic panel. The ends walls are shaped with generally U-shaped channels dimensioned to lock onto the ends of the bottom and side walls whereby a watertight concrete mold is formed. The concrete mold is assembled by pivoting the side walls to an upright position relative to the bottom by means of the living hinges and the end walls are then secured to the bottom and side walls. The mold can be disassembled for removal of a formed concrete specimen by removal of the end walls and pivoting the side walls downwardly to a generally coplanar relation with the bottom to expose the test specimen for removal.

6 Claims, 1 Drawing Sheet

FIG. 1
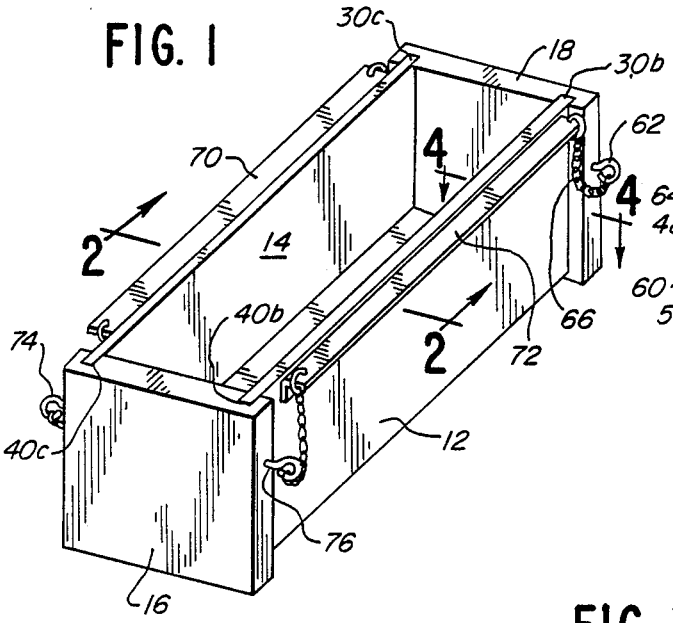
FIG. 2
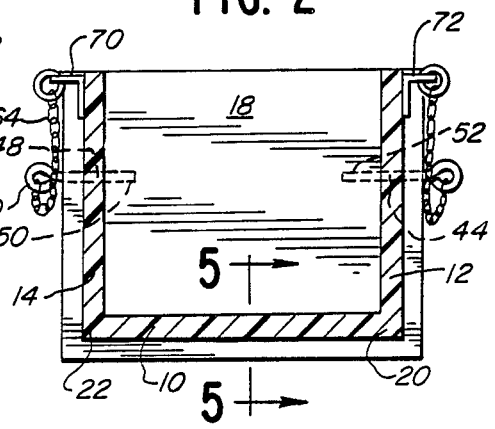
FIG. 3
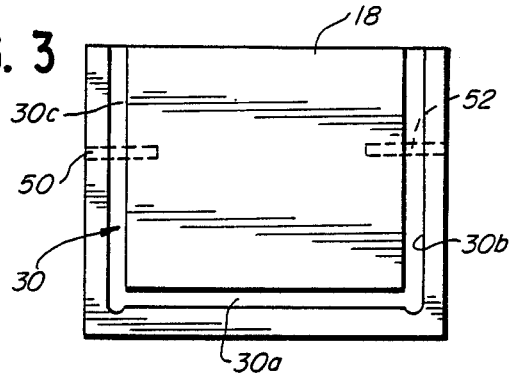
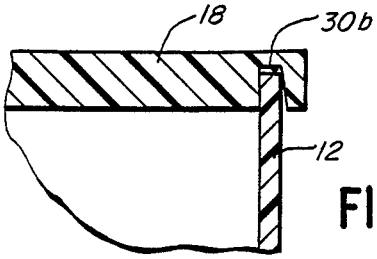
FIG. 4
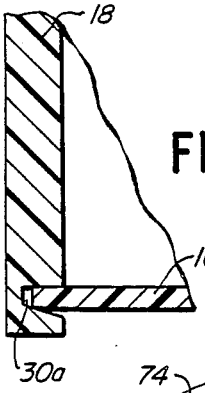
FIG. 5
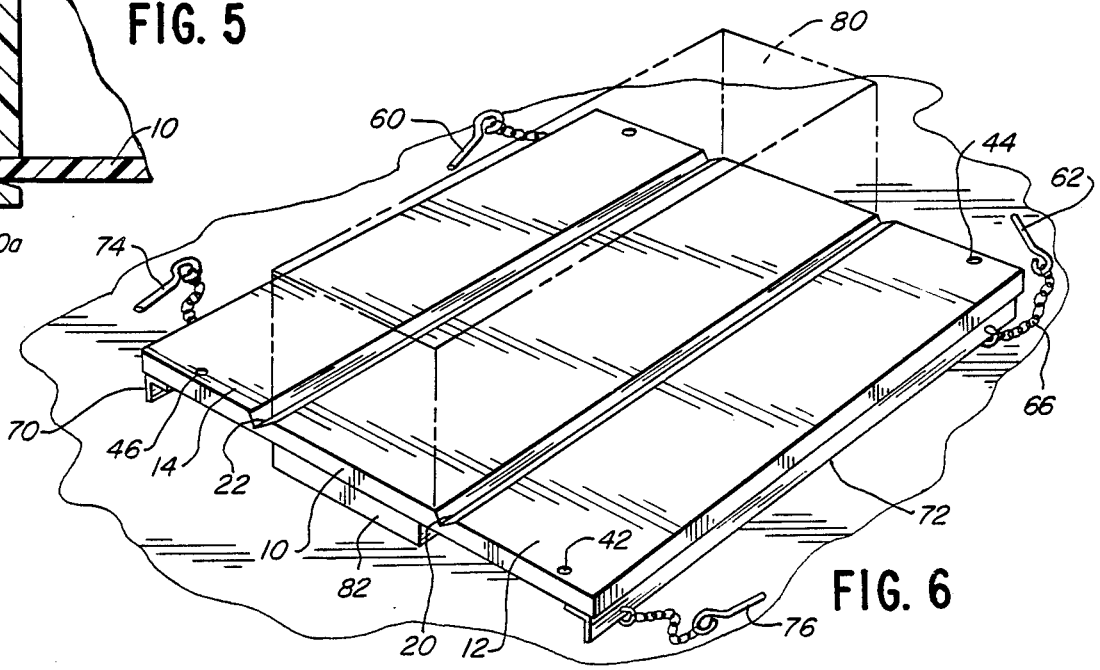
FIG. 6

LIGHTWEIGHT PLASTIC CONCRETE MOLD

DESCRIPTION

1. Field of the Invention

This invention pertains to a plastic mold for forming concrete test specimens and, more particularly, to a beam mold having a bottom and side walls with integral hinges and a pair of end walls which self-lock to the ends of the bottom and side walls to form a watertight mold and which avoids the problems inherent in previously known beam molds having lower strength-to-weight ratios.

2. Background of the Invention

A variety of concrete beam forms are commercially available for the purpose of forming a test specimen which can be subject to testing for compressive and flexural strength.

There are ASTM Standards for molds and, more particularly, beam molds. These Standards require that the mold be made of material nonreactive with concrete, be watertight, and hold their dimensions and shape under conditions of severe use. It is additionally required that components of the mold be at right angles to each other and have the strength to maintain certain predetermined dimensions.

A beam mold has a bottom, a pair of side walls, and a pair of end walls whereby a mold having a rectangular shape is formed. Typically, the commercially available beam molds are formed of steel components, with the mold components being held in assembled relation in various ways including the use of clamping studs, and/or hinges which are securely welded to the exterior of the walls and the bottom.

Another form of beam mold has a three-pieoe construction wherein two of the pieces each define a side wall and an end wall and these two pieces nest into a bottom. A special tool is required to disassemble the mold after the concrete has set.

In order to meet the ASTM Standards, the prior art beam molds having steel components have required a light coating of oil to enable release of the formed concrete from the beam mold and typically require an application of grease at the joints between components to satisfy the watertight requirement.

SUMMARY OF THE INVENTION

A primary feature of the invention is to provide a lightweight concrete mold having a bottom, a pair of side walls, and a pair of end walls all formed of plastic of sufficient thickness to provide the necessary strength for the mold and with the components being easily assembled and disassembled and constructed to be watertight without the use of grease or any other material and being inherently self-releasing from the formed concrete. Additionally, the mold has the capability of a major part thereof being stored flat in one piece when not in use.

An object of the invention is to provide a new and improved mold for forming concrete test specimens and, more particularly, for forming a concrete beam.

A preferred embodiment of the plastic concrete mold has a pair of side walls integral with a bottom and with these components formed from a panel of rigid plastic. Integral hinges between the bottom and side walls are defined by a pair of elongate sections of the panel of sufficiently reduced thickness to provide living hinges whereby the side walls may extend in a coplanar relation with the bottom for storage or be pivoted to a right-angular relation therewith in setting-up the mold. Additionally, a pair of end walls, formed of the same material, are each provided with a generally U-shaped channel for receiving an end of the bottom as well as an end of each of the side walls and locking thereto in a watertight relation to hold the components in assembled relation for forming a test specimen.

Another object of the invention is to provide a lightweight beam mold having a bottom and side walls formed from a single panel of rigid plastic and with the side walls hinged to the bottom for movement between beam-forming and beam-release positions by integral hinge elements defined by elongate sections of the panel of sufficiently reduced thickness to be flexible.

Still another object of the invention is to provide a lightweight beam mold, as described in the preceding paragraph, including a pair of end walls each having a generally U-shaped channel to releasably lock onto an end of said bottom and side walls and form a watertight seal for an end of the beam mold.

A further object of the invention is to provide a mold for forming concrete test specimens and having a bottom, a pair of side walls and a pair of end walls, the improvement comprising; said bottom and side walls being integral and formed from a single panel of rigid plastic material with hinges between the bottom and side walls being defined by elongate sections of the panel of sufficiently reduced thickness to be flexible, said elongate sections of the panel having sloped sides on each of the bottom and a side wall whereby the sloped sides abut when a side wall extends perpendicular to the bottom when the mold is assembled for use, and said end walls each having a generally U-shaped channel having a base of a width approximately equal to the thickness of said panel and side faces with at least one of the channel side faces extending at an obtuse angle from the channel base to increase the channel width to assist in assembly of an end wall to the associated side wall ends.

Still another object of the invention is to provide a mold as defined in the preceding paragraphs wherein said end walls and side walls have openings which align when the beam mold is assembled and a plurality of removable pins are positioned one in each of the aligned openings to maintain the locked relation between the end walls and side walls.

DESCRIPTION OF THE DRAWINGS

FIG. 1 is a perspective view of the fully assembled beam mold;

FIG. 2 is a transverse section of the beam mold, taken generally along the line 2—2 in FIG. 1;

FIG. 3 is an elevational view of an end wall looking toward the remote end wall in FIG. 1;

FIG. 4 is a fragmentary sectional view, taken generally along the line 4—4 in FIG. 1;

FIG. 5 is a fragmentary section through an end wall and a side wall, taken generally along the line 5—5 in FIG. 2; and FIG. 6 is a perspective view, showing the bottom and side walls of the mold in folded-out relation and with a formed, concrete beam shown in broken line.

DESCRIPTION OF THE PREFERRED EMBODIMENT

The mold for forming a concrete test specimen and, more particularly, a beam mold for forming a concrete beam is shown in assembled relation in FIGS. 1 and 2 and is comprised of a bottom 10, a pair of side walls 12 and 14, and a pair of end walls 16 and 18.

The bottom 10 and side walls 12 and 14 are of a one-piece integral construction, as shown in FIG. 6, and are formed from a plastic panel of sufficient thickness to have the required rigidity for use in forming a concrete test specimen. Although not intended to limit the disclosure to any one particular plastic, one example of a suitable plastic is high-density polyethylene. The side walls 12 and 14 are hingedly connected to the bottom 10 by living hinges. The hinge interconnecting the bottom 10 and side wall 12 is defined by an elongate section 20 of the panel which is of reduced thickness sufficient to provide a flexible hinge. The elongated section 20 has a generally V-shaped cross section to provide upwardly and outwardly sloping sides whereby the sloped sides abut when a side wall is pivoted upwardly to extend perpendicular to the bottom when the mold is being assembled for use. This assures formation of good corners for the test specimens.

A similarly constructed elongate section 22 provides the living hinge between the bottom 10 and the side wall 14.

The end walls 16 and 18 are of identical construction with the end wall 18 being shown in wall 12 and the bottom 10 in FIGS. 4 and 5, respectively. The end wall 18 has a generally U-shaped channel 30 with a transverse channel section **30*a* for receiving an end of the bottom 10 and a pair of upright cnannel 1 sections 30*b* and 30*c* for receiving an end of each of the side walls 12 and 14**, respectively.

The generally U-shaped channel 30, as seen particularly in FIGS. 4 and 5 for the channel sections **30*b* and 30*a*, respectively, has a base having a width approximately equal to the thickness of the bottom 10 and side walls 12 and 14 to form a tight fit therebetween to achieve a watertight connection. One of the side faces of the channel extends at an obtuse angle from the channel base to increase the channel width to assist in insertion of the ends of the side walls and bottom into the end wall channel. As previously stated, the end wall 16 is of the same construction as the end wall 18 and with the generally U-shaped channel thereof having upright channel sections 40*b* and 40*c* which receive ends of the side walls 12 and 14, respectively, and with a channel section, not shown, receiving an end of the bottom 10**.

A plurality of removable pins are provided to assure maintaining the assembled relation of the mold components. As seen in FIG. 6, the side wall 12 is provided with a pair of through openings 42 and 44 near opposite ends thereof and the side wall 14 is provided with a similar pair of openings, with one of these openings being shown at 46 in FIG. 6 and the other opening 48 being seen in broken line in FIG. 2. The end wall 18 has a pair of openings 50 and 52 extending from the exterior face thereof to a location inwardly of the channel sections whereby, with this end wall assembled as shown in FIG. 2, a removable pin 60 can be inserted into the aligned openings 48 and 50 and a removable pin 62 can be inserted into the aligned openings 44 and 52. Each of these removable pins is retained in association with the side walls when removed by means of the respective chains 64 and 66 which are attached to the respective elongate steel strips 70 and 72 secured to the mold side walls near the upper outer edges thereof and which can provide reinforcing to the side walls as may be required. These strips are of L-shaped cross section to provide increased strength and to provide handles.

A second pair of pins 74 and 76 hold the end wall 16 in assembled relation with the side walls and are similarly associated with the side walls by means of chains connected to the strips 70 and 72.

When disassembled, the mold components may be simply stored with the bottom and side walls being storable in a relatively flat condition as visualized in FIG. 6. When the mold is to be assembled, the side walls 12 and 14 are pivoted upwardly from the position shown in FIG. 6 to a position extending perpendicular to the bottom 10 and the respective end walls 16 and 18 are then forcibly locked to the bottom and side walls by fully seating the ends thereof in the channels of the end walls. The removable pins are then inserted in the aligned openings to lock the structure in assembled relation. After forming of the test specimen, the removable pins are removed and the end walls are knocked loose from the bottom and side walls and the side walls can then be pivoted downwardly to the position shown in FIG. 6 to enable lift-off of the formed test specimen, shown in broken line in FIG. 6 and identified by the reference numeral 80. A support member 82 is shown underlying the bottom 10 to enable the bottom and side walls to be in coplanar relation when removing the test specimen.

The mold, when assembled, is watertight and, therefore, no grease for water-sealing purposes is necessary. Also, it is not necessary to coat the surfaces of the mold with oil to facilitate release from the formed concrete since the plastic readily releases from the concrete. Any cleaning that may be required is readily accomplished by brushing the interior surfaces of the mold components.

We claim:

1. A lightweight beam mold having a bottom and side walls formed froma single panel of rigid plastic and with the side walls hinged to the bottom for movement between beam-forming and beam-release positions by integral hinge elements defined by elongate sections of the panel extending for the full length of the panel between the bottom and side walls and which are of sufficiently reduced thickness to be flexible, a pair of separate end walls each having a generally U-shaped channel removably attachable one to each end of the bottom and side walls when in beam-forming position, and said panel having at least one smooth surface to have smooth interior surfaces for the bottom and side walls and locking means to lock the end walls to the bottom and side walls.

2. A mold for forming concrete test specimens and having a bottom, a pair of side walls and a pair of end walls each having a generally U-shaped channel to receive an end of a bottom and one end of each side wall in watertight relation, the improvement comprising; said bottom and side walls being integral and formed from a single panel of rigid plastic material with continuous integral hinges between the bottom and side walls being defined by elongate sections extending for the full length of the panel and of sufficiently reduced thickness to be flexible.

3. A mold as defined in claim 1 wherein said elongate sections of the panel have sloped sides on each of the bottom and a side wall whereby the sloped sides abut when a side wall extends perpendicular to said bottom when the mold is assembled for use.

4. A mold as defined in claim 1 wherein an end wall channel has a base and side faces and the base has a width approximately equal to the thickness of said bottom and side walls, and at least one of said channel side faces extends at an obtuse angle from the channel base to increase the channel width to assist in assembly of an end wall to the associated side wall and bottom ends.

5. A mold as defined in claim 4 wherein an end wall has a pair of openings aligned with openings adjacent the ends of the side walls, and a plurality of removable pins insertable one in each of said aligned openings to lock the end wall to the side walls.

6. A lightweight beam mold for forming a concrete test specimen and having a bottom, a pair of side walls and a pair of end walls, said bottom and side walls being integrally formed from a panel of rigid plastic, means for hingedly connecting said side walls for pivoting relative to said bottom comprising two elongate full-length sections of said panel of reduced thickness to be flexible and defining a separation between the bottom and the side walls, and said end walls each having a generally U-shaped channel to receive an end of each of said bottom and the pair of side walls, the U-shaped channel having a cross section to tightly engage said ends and effect a watertight seal and locking means to maintain said seal.

* * * * *